United States Patent [19]

Marti

[11] Patent Number: 4,457,344

[45] Date of Patent: Jul. 3, 1984

[54] REED FOR A WEAVING MACHINE

[75] Inventor: Kurt Marti, Winterthur, Switzerland

[73] Assignee: Sulzer Brothers Limited, Winterthur, Switzerland

[21] Appl. No.: 321,198

[22] Filed: Nov. 13, 1981

[30] Foreign Application Priority Data

Nov. 20, 1980 [CH] Switzerland ..... 8580/80

[51] Int. Cl.[3] ..... D03D 49/62

[52] U.S. Cl. ..... 139/192

[58] Field of Search ..... 139/188 R, 190, 191, 139/192

[56] References Cited

U.S. PATENT DOCUMENTS

| | | | |
|---|---|---|---|
| 2,545,593 | 3/1951 | Slowak | 139/192 |
| 2,974,687 | 3/1961 | McFetters | 139/192 |
| 3,379,223 | 4/1968 | Fend | 139/192 |
| 4,351,367 | 9/1982 | McGinley | 139/191 |

FOREIGN PATENT DOCUMENTS

| | | | |
|---|---|---|---|
| 787501 | 12/1980 | U.S.S.R. | 139/192 |

*Primary Examiner*—Henry Jaudon

*Attorney, Agent, or Firm*—Kenyon & Kenyon

[57] ABSTRACT

The reed for the weaving machine has a specific weight which decreases in a direction away from the sley. In one embodiment, the dents of the reed are tapered while in other embodiments the dents are provided with perforations or are made of different materials.

12 Claims, 4 Drawing Figures

REED FOR A WEAVING MACHINE

This invention relates to a reed for a weaving machine.

As is known, weaving machines employ reciprocating reeds for the beating-up of a weft yarn into a beat-up position of a shed of warp yarns for forming a cloth. Generally, these reeds are formed of a rectangular frame with a plurality of parallel dents between which the warp yarns are positioned. Usually, as described in German Pat. No. 2 057 880, the reeds as well as the dents have a uniform cross-sectional width (i.e. thickness) over their entire length. As a result, it has been found that the inertia forces occurring during reciprocation of such a reed, particularly in very high speed machines, are excessive. Further, vibrations and noise result which are disturbing to the operation of the weaving machines.

Accordingly, it is an object of the invention to reduce the inertia forces occurring during reciprocation of a reed in a weaving machine.

It is another object of the invention to reduce the vibration and noise attendant with the operation of a reed of a weaving machine.

Briefly, the invention provides a reed for a weaving machine which is characterized in having a specific weight which decreases in a direction from the bottom to the top of the reed, that is, in a direction away from the sley in which the reed is usually mounted. In particular, the reed is constructed with a plurality of parallel dents, at least some of which have a specific weight decreasing in a direction from one end to the other.

By reducing the specific weight of the reed in a direction away from the sley, the mass inertia moment characteristic of the reed is greatly improved without seriously reducing the strength of the dents. Since the weight which has to be moved is reduced, there are also savings in material and energy.

In one embodiment, the reed is constructed to have a tapering cross-sectional shape. This permits the dents to be produced in a relatively simple manner. For example, the ratio of the maximum width to minimum width of the cross-sectional shape may be in the range of from approximately 1.5:1 to 4:1.

In another embodiment, the dents may be made with a curved flank. This optimizes the stress distribution in the dents during operation.

In still another embodiment, the reeds may be made of less dense material at one end than at the opposite end. This provides the advantage of reducing weight without entailing any great change in the shape and stability of the dents.

In still another embodiment, the dents may be provided with perforations. This permits a very simple way of reducing the specific weight of the reed. In addition, the dents may be made of metal with plastic inserts at one end.

These and other objects and advantages of the invention will become more apparent from the following detailed description taken in conjunction with the accompanying drawings wherein.

Figure 1:
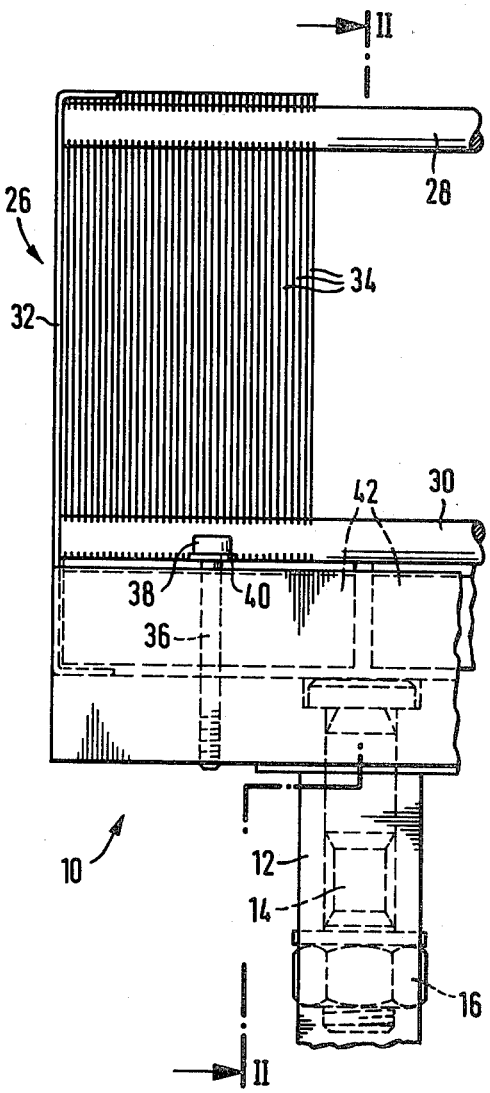
FIG. 1 illustrates a front view of a part of a reed constructed in accordance with the invention and mounted in a sley.

Referring to FIG. 1, a sley 10 of conventional construction is secured on a number of sley levers 12 (only one of which is shown) via a plurality of bolts 14 and nuts 16. The sley 10 extends substantially over the full weaving width of the weaving machine which is not otherwise shown while the levers 12 are disposd on a sley shaft (not shown) which is connected to the machine drive. The levers 12 serve to pivot the sley 10 in the direction indicated by the arrow 18 (see FIG. 2) during operation.

Figure 2:
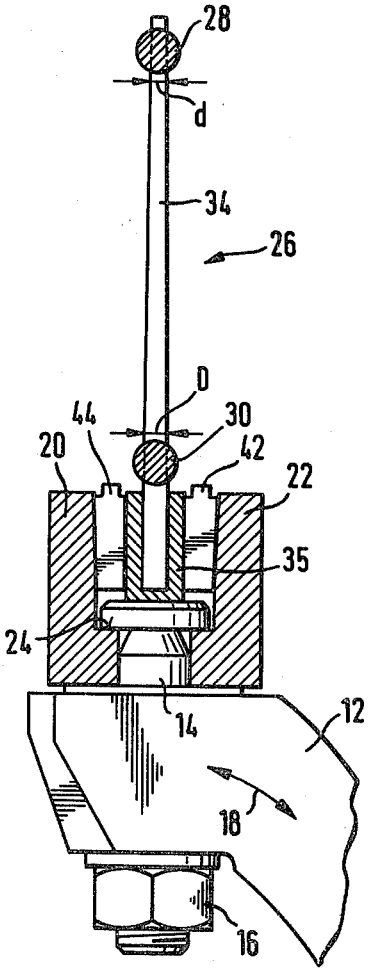
FIG. 2 illustrates a view taken on line II—II of FIG. 1.

As shown in FIG. 2, the sley 10 is of substantially channel-shaped cross-section with a pair of flanges 20, 22 having slightly tapered side walls defining a longitudinally disposed recess 24 which extends over the entire length of the sley 10.

As shown in FIGS. 1 and 2, a reed 26 is secured within the recess 24 of the sley 10. This reed 26 includes a mounting block 35, a pair of spaced horizontal parallel rods 28, 30 and two end rods 32 which interconnect the rods 28, 30 at the ends (only one end rod 32 is illustrated in FIG. 1). In addition, a plurality of spaced parallel dents 34 are secured to and across the rods 28, 30 and are mounted in the mounting block 35. These dents 34 are distributed over the weaving width and are secured to the rods 28, 30 in known manner. As indicated in FIG. 2, the mounting block 35 is of U-shaped cross-section and has the dents 34 secured therein in known manner.

The reed 26 is mounted within the sley 10 by means of clamping elements 42, 44 and screws 36. The clamping elements 42, 44 are distributed over the weaving width to opposite sides of the reed 26 while, as indicated in FIG. 1, each screw 36 has a head 38 and a washer 40 between a head 38 and a clamping element 42.

Referring to FIG. 2, the side profile or cross-sectional shape of the dents 34 narrows from the sley end to the upper end. Thus, the reed 26 has a specific weight which decreases in a direction from the sley 10 to the upper end. For example, the cross-sectional shape of the reed 26 narrows away from the sley shaft from a maximum width D to a minimum width d. Conveniently, the ratio D:d is between approximately 1.5:1 and 4:1.

Figure 3:
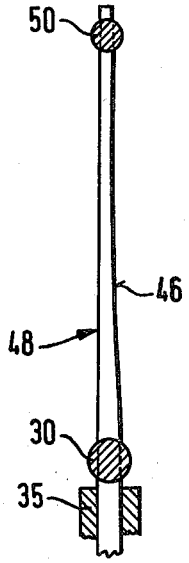
FIG. 3 illustrates a part cross-sectional view of a modified reed according to the invention.

Referring to FIG. 3, wherein like reference characters indicate like parts as above, the reed may be constructed with dents 48 which have a curved flank 46. In this case, the top connecting rod 50 is of smaller diameter than the lower rod 30 and therefore lighter.

Figure 4:
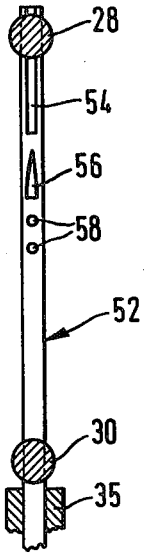
FIG. 4 illustrates a part cross-sectional view of a further modified reed according to the invention.

Referring to FIG. 4, wherein like reference characters indicate like parts as above, the reed may be constructed with steel dents 52 of conventional rectangular shape. However, these dents 52 may have inserts 54 in the parts remote from the sley 10 which are made of a lower density substance, for example plastics, which is injected or adhered into corresponding slit-like recesses. In addition, the dents 52 may be provided with perforations in the form of slots 56 and apertures 58 in order to reduce the weight.

Alternatively, the dents can be made of a metal/plastics sandwich construction in a top part which is remote from the sley 10.

The invention thus provides a reed which produces smaller inertia forces during operation than previously known reeds of uniform specific weight characteristics. The embodiment according to FIG. 4 has the specific advantage that standard steel strip may be used for the steel dents.

What is claimed is:

1. A reed for a weaving machine having a plurality of parallel spaced apart dents, at least some of said dents being of less dense material at an upper end than at an opposite end to have a specific weight which decreases in a direction from the bottom to the top of said reed.

2. A reed as set forth in claim 1 having a tapering cross-sectional shape.

3. A reed as set forth in claim 2 wherein the ratio of maximum width to minimum width of cross-sectional shape is in the range of from approximately 1.5:1 to 4:1.

4. A reed for a weaving machine comprising a mounting block;

a pair of spaced parallel rods; and a plurality of parallel dents secured across said rods and mounted in said block, at least some of said dents having a specific weight decreasing in a direction away from said mounting block.

5. A reed as set forth in claim 4 wherein at least some of said dents are tapered.

6. A reed as set forth in claim 4 wherein at least some of said dents have a concave curved flank.

7. A dents as set forth in claim 4 wherein at least some of said reeds are perforated.

8. A reed as set forth in claim 4 wherein at least some of said dents are made of metal and have plastic inserts at an end remote from said mounting block.

9. A reed as set forth in claim 4 wherein said mouting block has a U-shaped cross-section and said dents are secured within said block.

10. A reed for a weaving machine characterized in having cross-sectional shape with a specific weight which decreases in a direction from the bottom to the top of said reed and in having a plurality of parallel spaced apart dents with at least one of said dents having a curved flank.

11. A reed for a weaving machine having a plurality of parallel spaced apart dents, at least some of said dents having perforations therein to have a specific weight which decreases in a direction from the bottom to the top of said reed.

12. The combination of a sley for extending substantially over a weaving width of a weaving machine and a reed, said reed having a mounting bolck mounted within said sley, a plurality of parallel dents mounted in said block with at least some of said dents having a specific weight decreasing in a direction away from said mounting block and a pair of parallel rods secured to said dents.

* * * * *

UNITED STATES PATENT AND TRADEMARK OFFICE

CERTIFICATE OF CORRECTION

PATENT NO. : 4,457,344

DATED : July 3, 1984

INVENTOR(S) : Kurt Marti

It is certified that error appears in the above-identified patent and that said Letters Patent is hereby corrected as shown below:

| Column | Line | Correction/Change From | TO |
|---|---|---|---|
| 3 | 25 | "dents" | -- reeds -- |
| 3 | 26 | "reeds" | -- dents -- |
| 4 | 20 | "bolck" | -- block -- |

Signed and Sealed this

*Eleventh* Day of *December 1984*

[SEAL]

*Attest:*

*Attesting Officer*

GERALD J. MOSSINGHOFF

*Commissioner of Patents and Trademarks*